US007044131B2

(12) United States Patent
Griesbach, III et al.

(10) Patent No.: US 7,044,131 B2
(45) **Date of Patent: *May 16, 2006**

(54) DISPOSABLE FACE MASK

(75) Inventors: Henry Louis Griesbach, III, Clarkston, GA (US); Daryl S. Bell, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/847,773

(22) Filed: May 18, 2004

(65) Prior Publication Data

US 2004/0255944 A1 Dec. 23, 2004

Related U.S. Application Data

(63) Continuation-in-part of application No. 10/325,262, filed on Dec. 19, 2002, now Pat. No. 6,941,949.

(51) Int. Cl.
*A62B 18/02* (2006.01)

(52) U.S. Cl. ..... 128/206.21; 128/207.11

(58) Field of Classification Search ..... 128/205.27, 128/206.19, 206.21, 207.11, 207.17
See application file for complete search history.

(56) References Cited

U.S. PATENT DOCUMENTS

| | | | |
|---|---|---|---|
| 879,391 | A | 2/1908 | Leonard |
| 911,476 | A | 2/1909 | Cheesman |
| 1,224,039 | A | 4/1917 | Synohubyk |
| 1,344,349 | A | 6/1920 | Mickelson |
| 1,606,531 | A | 11/1926 | Hart |
| 2,353,643 | A | 7/1944 | Bulbulian |
| 2,354,840 | A | 8/1944 | Seletz |
| 2,379,493 | A | 7/1945 | Morehouse |
| 2,507,447 | A | 5/1950 | La Joie et al. |
| 2,634,725 | A | 4/1953 | Lo Presti |
| 2,667,869 | A | 2/1954 | D'Elia |
| 2,810,385 | A | 10/1957 | Reed |
| 3,040,741 | A | 6/1962 | Carolan |
| 3,058,463 | A | 10/1962 | Goodrich, Jr. |
| 3,117,574 | A | 1/1964 | Replogle |
| 3,234,939 | A | 2/1966 | Morton, Jr. |
| 3,664,335 | A | 5/1972 | Boucher et al. |
| D224,277 | S | 7/1972 | Venaleck |
| 3,929,135 | A | 12/1975 | Thompson |
| 4,084,585 | A | 4/1978 | Venaleck |
| 4,195,629 | A | 4/1980 | Halford |
| 4,196,728 | A | 4/1980 | Granite |
| 4,300,240 | A | 11/1981 | Edwards |
| 4,473,071 | A | 9/1984 | Hunt |
| 4,536,440 | A | 8/1985 | Berg |
| 4,573,217 | A | 3/1986 | Reed |
| 4,606,341 | A | 8/1986 | Hubbard et al. |
| 4,635,628 | A | 1/1987 | Hubbard et al. |
| 4,662,005 | A | 5/1987 | Grier-Idris |

(Continued)

*Primary Examiner*—Aaron J. Lewis
(74) *Attorney, Agent, or Firm*—Sue C. Watson

(57) ABSTRACT

A disposable face mask includes a mask body covering substantially a nose and mouth of a wearer, and a connecting means included with the mask body. The connecting means includes a pair of ties, an elastic cord, and/or an extension having lateral panels which have a connectable section. A cord is coupled to and extends between at least one pair of lateral panels. The connecting means is configured to releasable encircle a back of a wearer's head to hold a mask body in position over a wearer's nose and mouth.

32 Claims, 3 Drawing Sheets

U.S. PATENT DOCUMENTS

| | | | | |
|---|---|---|---|---|
| 4,671,268 | A | 6/1987 | Hunt | |
| 4,671,271 | A | 6/1987 | Bishop et al. | |
| 4,729,371 | A | 3/1988 | Krueger et al. | |
| 4,790,307 | A | 12/1988 | Haber et al. | |
| 4,815,456 | A | 3/1989 | Rubin et al. | |
| D300,571 | S | 4/1989 | Waters, Jr. | |
| 4,920,960 | A | 5/1990 | Hubbard et al. | |
| 4,969,457 | A | 11/1990 | Hubbard et al. | |
| 5,035,006 | A | 7/1991 | Hetz et al. | |
| 5,116,682 | A | 5/1992 | Chakravarti et al. | |
| 5,145,727 | A | 9/1992 | Potts et al. | |
| 5,151,321 | A | 9/1992 | Reeves et al. | |
| 5,265,280 | A | 11/1993 | Walsh | |
| 5,467,765 | A | 11/1995 | Maturaporn | |
| 5,511,541 | A | 4/1996 | Dearstine | |
| 5,542,128 | A | 8/1996 | Lomas | |
| 5,561,863 | A | 10/1996 | Carlson, II | |
| 5,595,174 | A | 1/1997 | Gwaltney | |
| 5,628,308 | A | 5/1997 | Harges, Jr. et al. | |
| 5,701,892 | A | 12/1997 | Bledstein | |
| 5,704,068 | A | 1/1998 | Martin | |
| 5,706,802 | A | 1/1998 | McCormick | |
| 5,717,991 | A | 2/1998 | Nozaki et al. | |
| 5,819,731 | A | 10/1998 | Dyrud et al. | |
| 6,055,982 | A | 5/2000 | Brunson et al. | |
| 6,173,712 | B1 | 1/2001 | Brunson | |
| 6,323,389 | B1 | 11/2001 | Thomas et al. | |
| 6,422,238 | B1 | 7/2002 | Lithgow | |
| 6,536,435 | B1 * | 3/2003 | Fecteau et al. | 128/207.11 |
| 6,691,314 | B1 * | 2/2004 | Grilliot et al. | 2/5 |
| 6,732,733 | B1 * | 5/2004 | Brostrom et al. | 128/206.27 |
| 6,820,615 | B1 * | 11/2004 | Feng | 128/201.27 |

* cited by examiner

DISPOSABLE FACE MASK

CROSS REFERENCE TO RELATED APPLICATIONS

The present application is a continuation-in-part of U.S. Ser. No. 10/325,262 filed Dec. 19, 2002 now U.S. Pat. No. 6,941,949, entitled "Disposable Face Mask."

BACKGROUND

This invention generally relates to face masks, and more specifically, to face masks used in clean rooms, medical facilities, and so forth.

Disposable and non-disposable face masks have been in use for many years. In the medical field, many early masks were used to prevent contamination and resulting infection of patients, particularly during surgery. In recent years, there has also been an increased awareness and concern for preventing contamination and infection of the public and health care personnel by airborne pathogens. Therefore, it has become necessary to prevent the spread of infections from person to person, from patient to health care worker, and vice versa by preventing inhalation of airborne infectious aerosols and/or particulate matter.

A face mask desirably covers a health care personnel's, a patient's, or a person's (hereinafter "wearer" or "wearer's") nose and mouth, and even more desirably, a portion of the wearer's face, i.e., checks, jaw, chin, and so forth. Many face masks have ties on each side, while some face masks have an elastic band which extends from one side of the mask to the other. Face masks or worn for many hours in some instances. The face mask presses against the face of the wearer, and can become uncomfortable.

A need exists for a disposable face mask which permits a degree of adjustability at an upper portion of the face mask and a lower portion of the face mask, to increase the comfort and versatility of the face mask when it is worn for a period of time. Such a disposable face mask has adjustability, and also includes features and characteristics which permits it from easily falling off of a wearer when the face mask is released from a wearer's face.

DEFINITIONS

As used herein, the term "pathogen" refers to an agent that causes diseases, including, but not limited to a living microorganism, such as, a bacterium, a fungus, a virus, prions/proteins, and so forth.

As used herein, the term "aerosol" refers to a gaseous suspension of solid and/or liquid particles.

As used herein, the term "particulate matter" refers to a substance formed of separate particles, i.e., one or more particles.

As used herein, the term "fluid" refers to any gas, liquid, or mixture of gas and liquid; various types of aerosols and particulate matter may be entrained with such fluids.

As used herein, the term "couple" includes, but is not limited to, joining, attaching, connecting, fastening, linking, or associating two things integrally or interstitially together. Such coupling may be, but not by way of limitation, releasable such that the two things may be re-coupled.

The term "contaminant" shall mean a chemical agent or biological organism/pathogen that can potentially harm a human being or animal; the term "contamination" refers to the act or process of contaminating.

These terms may be defined with additional language in the remaining portions of the specification.

SUMMARY OF THE INVENTION

In response to the difficulties and problems discussed above, a disposable face mask is provided, which includes a mask body configured to substantially cover a nose and mouth of a wearer. The mask also includes a connecting means provided with the mask body which holds at least a portion of the mask body in position on a wearer's face. The connecting means are configured to releasably extend about a back of a user's head. The mask further includes an extension provided with the mask body. The extension includes two lateral panels. The lateral panels are configured to cooperate to encircle a back of a wearer's head. Each lateral panel includes a connectable section on each free end of each lateral panel. Each connectable section is configured to be releasably coupled together at a back of a wearer's head. One end of a cord is connected to one lateral panel and an opposite end of the cord is connected to another lateral panel. When the connecting means are released from a back of a user's head, and when the two connectable sections are un-coupled and released from each other, the face mask moves from a wearer's face downward toward a front of a wearer's neck and is held about a wearer's neck by the cord's connection between the two lateral panels.

In another aspect of the invention, a disposable face mask is provided, which includes a mask body configured to substantially cover a nose and mouth of a wearer. The mask also includes a first extension provided with the mask body. The first extension includes a pair of first lateral panels. The first lateral panels are configured to cooperate to encircle a back of a wearer's head. Each first lateral panel includes a connectable section on each free end of each first lateral panel. Each connectable section is configured to be releasably coupled together at a back of a wearer's head. The mask further includes a second extension provided with the mask body. The second extension includes a pair of second lateral panels. The second lateral panels are configured to cooperate to encircle a back of a wearer's head. Each second lateral panel includes a connectable section on each free end of each second lateral panel. Each connectable section is configured to be releasably coupled together at a back of a wearer's head. The mask further includes a cord coupled to and extending between at least one of the first pair of lateral panels and the second pair of lateral panels. When the two connectable sections of the first lateral panels and the second lateral panels are un-coupled and released from each other, the face mask moves from a wearer's face downward toward a front of a wearer's neck and is held about a wearer's neck by the cord's connection between the lateral panels.

DETAILED DESCRIPTION

Figure 1:
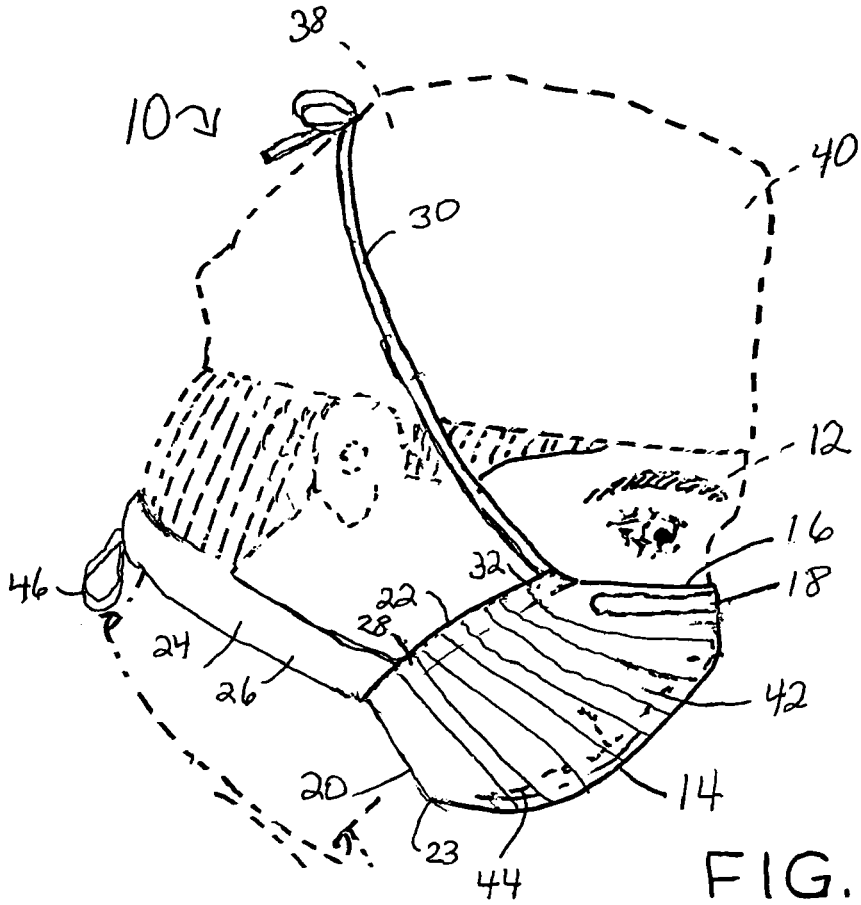
FIG. 1 is a side view of a disposable face mask which is shown being worn by a wearer (illustrated in phantom lines)

Reference will now be made in detail to the presently preferred embodiments of the invention, one or more examples of which are illustrated in the drawings. Each example is provided by way of explanation of the invention and is not meant as a limitation of the invention. For example, features illustrated and described as part of one embodiment or figure can be used on another embodiment or figure to yield yet another embodiment. It is intended that the present invention include such modifications and variations.

Disposable face masks 10, 110, 210 incorporating various features of the present invention may be used to retard or prevent the entrance or escape of fluids, particulate matter and/or aerosols to a wearer or from the nose and/or mouth. Such disposable face masks 10, 110, 210 provide easy adjustability and therefore comfort to a wearer to encourage compliance when a disposable face mask is required. Similarly, easy adjustability and comfort is important for wearers who are medical personnel, who may be required to wear disposable face masks for many hours daily.

The present invention provides a barrier about the nose, mouth, and desirably at least a portion of a wearer's cheeks, jaw, and chin. The present invention presents a barrier to the passage of aerosols and/or particulate matter for the wearer while at the same time reducing and/or eliminating the transfer of aerosols, fluids, and/or particulate matter from the wearer to a another person. The present disposable face mask provides an adjustable and comfortable fit for extended periods of wear, with easy pull-on/pull-off features. The present invention desirably uses one or more layers of filter media or barrier material which is designed to filter the passage of aerosols, fluids and/or particulate matter.

Figure 2:
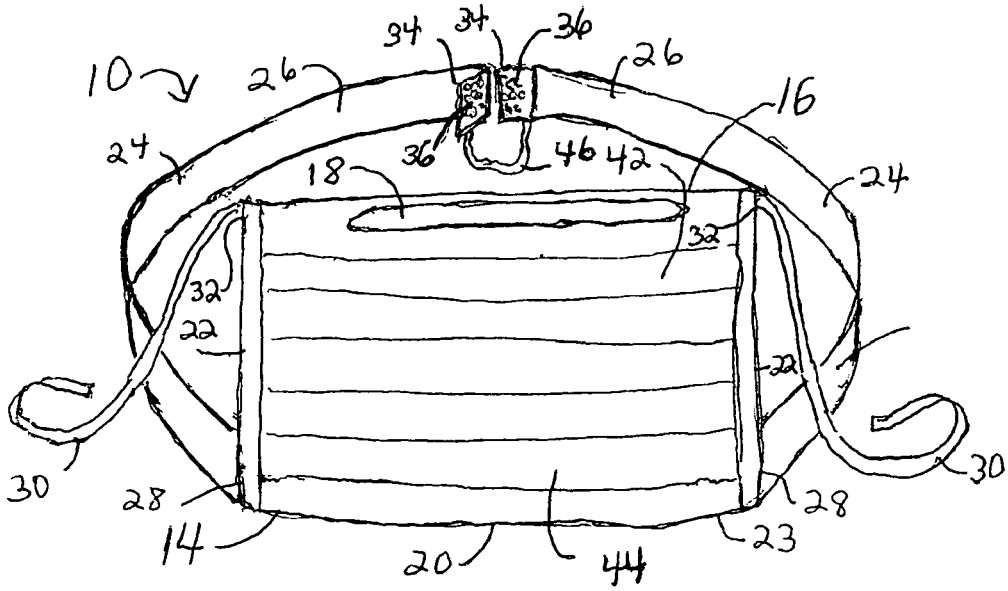
FIG. 2 is a perspective view of the disposable face mask of FIG. 1.

Turning now to FIGS. 1 and 2, a face mask 10 incorporating some of the features and characteristics of the present invention is illustrated in FIG. 1, and which is positioned over a portion of a wearer's face 12, that is, a wearer's nose, mouth, and portions of the wearer's cheeks, jaw, chin, and so forth, as illustrated in FIG. 1 (wearer shown in phantom lines). The face mask 10 includes a mask body 14 which substantially covers the wearer's nose and mouth. As shown in FIGS. 1 and 2, the mask body 14 is generally pleated and extends over a portion of the wearer's face. Examples of pleated masks are disclosed in U.S. Pat. No. 4,635,628 to Hubbard et al. issued Jan. 13, 1987, U.S. Pat. No. 4,969,457 to Hubbard et al., issued Nov. 13, 1990, and U.S. Pat. No. 4,920,960 to Hubbard et al. issued May 1, 1990, all of which are hereby incorporated by reference in their entirety. Many pleated masks are known and commercially available.

Figure 4:
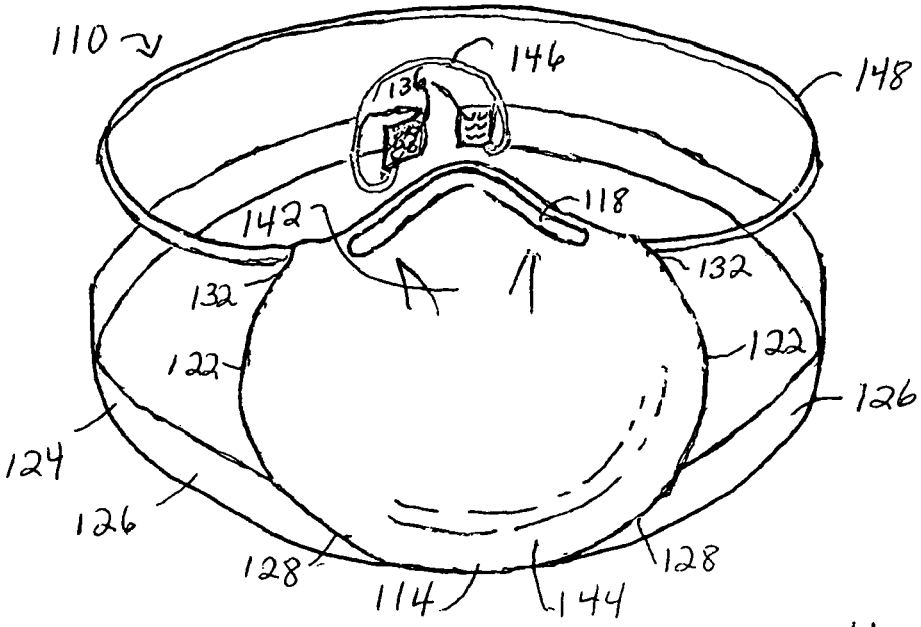
FIG. 4 is a perspective view of the disposable face mask of FIG. 3.
Figure 5:
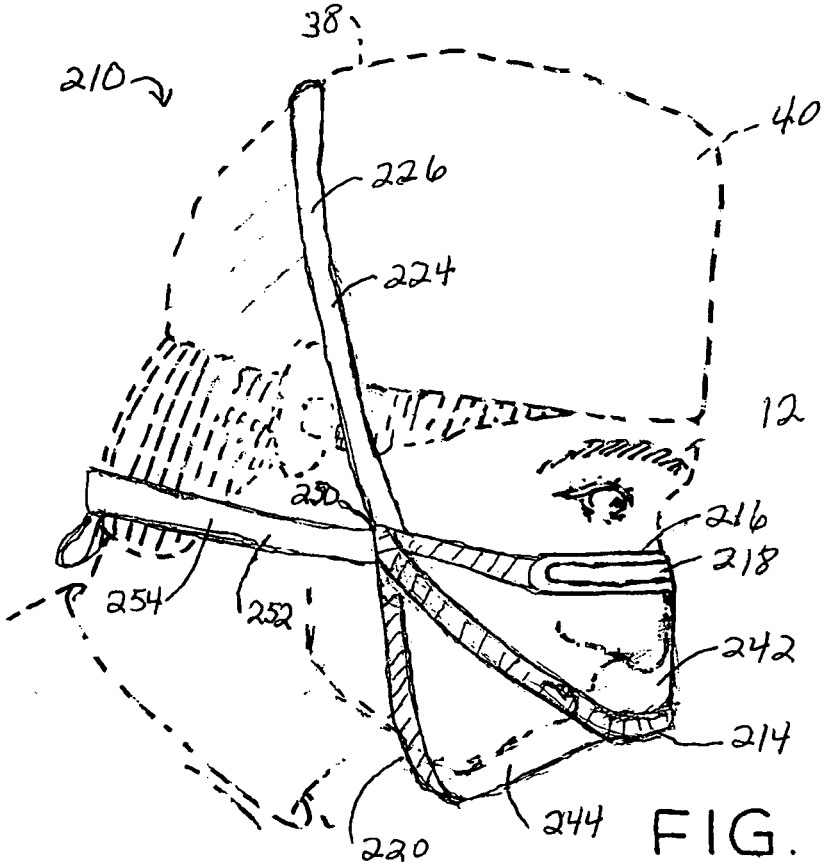
FIG. 5 is a side view of yet another embodiment of a disposable face mask which is shown being worn by a wearer (illustrated in phantom lines)
Figure 6:
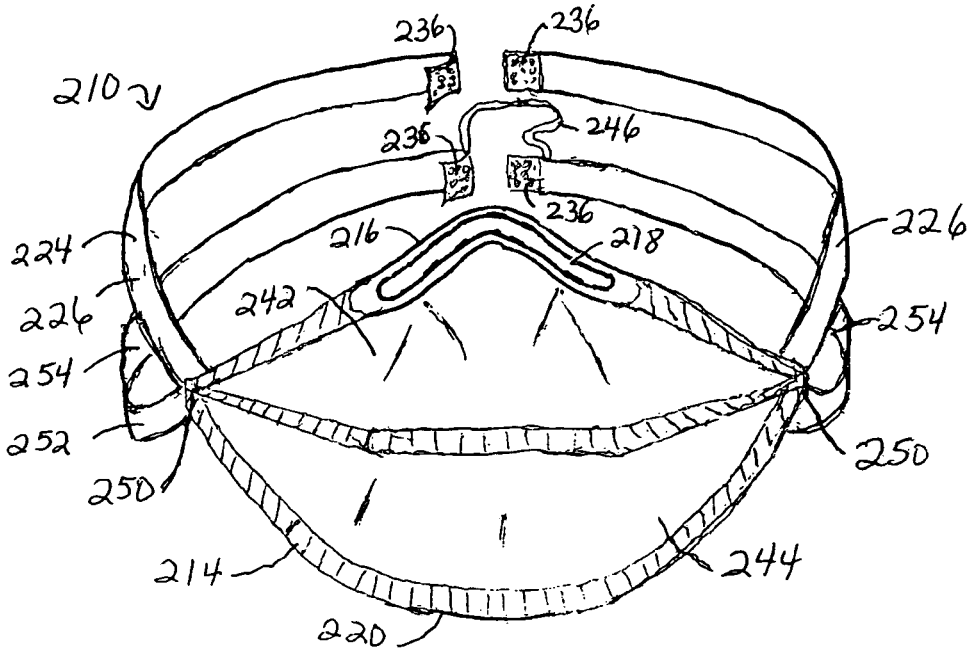
FIG. 6 is a perspective view of the disposable face mask of FIG. 5.

Alternatively, however, the mask body 24 may be cone-shaped (FIGS. 3 and 4), duck bill-shaped (not shown), or a similar single fold and/or noncollapsible-shaped (FIGS. 5 and 6). These types of mask body provides "off-the-face" benefits while still being easy to stack, package, store and ship. Cone-shaped, duck bill-shaped and noncollapsible shaped "off-the-face"-style masks may provide, to some wearers, a larger breathing chamber as compared to the soft, pleated masks which may contact more of the wearer's face. Examples of generally cone-shaped masks are disclosed in U.S. Pat. No. 4,536,440 to Berg issued Aug. 20, 1985 and U.S. Pat. No. 4,729,371 to Krueger et al., issued Mar. 8, 1988, both of which are incorporated by reference in their entirety. Many cone-style face masks are known and commercially available. An example of a generally duck bill-shaped mask is disclosed in U.S. Pat. No. 4,606,341 to Hubbard et al. Examples of generally noncollapsible shaped masks are disclosed in U.S. Pat. No. 6,055,982 issued to Brunson et al., May 2, 2000, and U.S. Pat. No. 6,173,712 issued to Brunson Jan. 16, 2001, both of which are incorporated by reference in their entirety.

Desirably, the mask body 14 includes barrier material. The barrier material will desirably be positioned so that aerosols, fluids, and/or particulate matter contacting the mask 10 from the outside will be filtered. It will be understood that the barrier material may be positioned on any inner or outer surface of the mask, or in any layer intermediate to an inner or outer surface.

The barrier material may include filtration media, which may be, for example, meltblown polypropylene or polyester. The filtration media may be provided to reduce the passage of airborne bacteria in either direction which will prevent passage of germs to and from the wearer 11. In addition, the barrier material may further include an inner layer which contacts the face of the wearer. Such an inner layer is desirably constructed of a light weight, highly porous, softened, non-irritating, non-woven fabric, such as Dexter, Inc. product No. 3768. Such an inner layer is designed to prevent unwanted materials such as facial hair, loose fibers or perspiration from contacting the barrier and other layers which might cause a wicking effect to draw liquids through any section, lateral portion and/or the mask body. The inner layer may provides a comfortable surface for contact with the face of the wearer.

The barrier material may also include a layer capable of differentiating between gases and liquids and may be, for example, Tredegar Film Products aperture low density polyethylene. Non-wetting materials, such as those used to form the barrier material, have small apertures which prevent liquids with a relatively high surface tension from passing therethrough yet will allow gases with a low surface tension to pass therethrough. It is preferable to have the apertures as large as possible to allow easy breathing, and yet small enough to retard or prevent the flow of liquids. The barrier material desirably is designed to freely pass gases in either direction, while restricting the passage of liquids in at least one direction. It will be appreciated, however, that one barrier material may be utilized, and more than one barrier material may be used. Further description of the construction and operation of such barrier material may be found in U.S. Pat. Nos. 3,929,135 to Thompson, and U.S. Pat. No. 6,055,982 to Brunson et al., both of which are incorporated by reference in their entirety herein. Exemplary barrier materials include, but are not limited to, those disclosed in U.S. Pat. No. 4,635,628 to Hubbard et al. issued Jan. 13, 1987, U.S. Pat. No. 4,969,457 to Hubbard et al., issued Nov. 13, 1990, and U.S. Pat. No. 4,920,960 to Hubbard et al. issued May 1, 1990, all of which are hereby incorporated by reference in their entirety. Other barrier materials are known, and are commercially available, which may also be used.

The mask body 14 covers a portion of the wearer's face 12, as noted previously. As illustrated in FIGS. 1 and 2, a top edge 16 of the mask body 14 may desirably include an elongated malleable member 18. The malleable member 18 is provided so that top edge 16 of mask body 14 can be configured to closely fit the contours of the nose and upper cheeks of the wearer. The malleable member 18 is preferably constructed from a metal strip with a rectangular cross-section, but may form any suitable configuration, and may also be a moldable or a malleable metal or alloy, plastic, or any combination thereof. The top edge 16, a lower edge 20, and opposite side edges 22 cooperate to define an outer periphery 23 of the mask body 14.

A connecting means or an extension 24 includes a pair of lateral panels 26 which are, at one end, joined to one of each of the side edges 22 of the mask body 14 by the use of various adhesives, ultrasonic bonds (sometimes referred to as ultrasonic welds), sewn thread, heat bonds, and so forth. As shown in FIGS. 1 and 2 in a non-limiting example, the lateral panels 26 are joined to a lower section 28 of the side edges 22 of the mask body 14 Alternatively, the lateral panels 26 are provided in a unitary construction along with the mask body 14 (not shown). A connecting means or a pair of standard strings or ties 30 are connected to an upper section 32 of the side edges 22 of the mask body 14.

In the present embodiment, the lateral panels 26 have free ends 34, each of which include, at or near the free ends 34, connectable sections 36 to permit them to releasably couple together, as shown best in FIG. 2. One or more fasteners or connectable sections 36 releasably couple together, to provide further adjustability to ensure for a comfortable yet firm fit of the mask 10. The connectable sections 36 are provided to releasably couple or connect at the back 38 of the wearer's head 40 by use of commercially available hook and loop material, snaps, buttons and button holes, mechanical hooks and loops, adhesives, including cohesive adhesives, pressure sensitive adhesives, and so forth, disposed on a portion of each free end 34 to provide each connectable section 36. It will be appreciated that the placement of the connectable sections 36 is non-limiting; the connectable sections 36 may be positioned on any portion of the lateral panels 26 so or any other area of the mask 10 so long as they operate as shown and/or described herein.

The pair of ties 30 permit an upper portion 42 of the mask body 14 to be fastened together in a traditional manner to the wearer's face 12 via tying the ties 30 in a bow, knot, and so forth, at the back 38 of a wearer's head 40. The ties 30 may be un-fastened to release the upper portion 42 of the mask body 14 from the wearer's face. Similarly, the connectable sections 36 may be released to release a lower portion 44 of the mask body 14 such that the mask 10 drops away from the wearer's face 12 but is held about the wearer's neck via a connection of a cord 46 to each of the lateral panels 26.

A cord 46 is attached to each connectable section 36 desirably on or near each free end 34 thereof, and it extends therebetween. The cord 46 facilitates removing the mask 10 while allowing the mask 10 to hang around the wearer's neck (not shown) when: the ties 30 are un-fastened to release the upper portion 42 of the mask body 14 from the wearer's face 12, and the lateral panels 26 are uncoupled via the connectable sections 36 to release the lower portion of the mask body 14 from the wearer's face 12. The cord 46 may be a cord, a strap, a string, and/or a ribbon constructed from a non-elastomeric material. Alternatively, the cord 46 may be constructed from any suitable elastic and/or elastomeric material, and desirably, such as, by way of non-limiting example, rubber, elastic covered yarn, an elastomeric material wrapped with nylon or polyester, and so forth. In yet another alternative, the cord 46 may be constructed of both an elastomeric material and a non-elastomeric material.

Lateral panels 26, the cord 46 and/or the ties 30 may be formed from any of the materials of the mask body 14 or any other material in the mask 10. Alternatively, lateral portions 26, the cord 46, the ties 30, and/or any portion of the mask body 14 may include an elastic or an elastomeric material, such as, by way of non-limiting example, spandex, and so forth. One commercial example of spandex includes LYCRA®, available from DuPont Apparel & Textile Science, Wilmington, Del. Other commercially available spandex materials include VYRENE®, DORLASTAN®, SPANZELLE®, GLOSPAN®, and so forth. An example of a natural material for forming an elastic or elastomeric material is natural rubber. Any stretchable nylon, polyester (double knit, circle knitted, and so forth) product, and other known commercially available elastic or elastomeric materials may also be used.

Another product is which may be used, alone or in combination with any of the afore-mentioned materials in providing any portion of the mask 10, including those mentions above, is a continuous feed spun bonded laminate (hereinafter "CFSBL") having improved elastic properties measured at body temperature. This laminate has at least one first and second nonelastic layers between which is sandwiched at least one elastic layer. The elastic layer is comprised of a triblock polystyrene-poly(ethylene/propylene)-polystyrene ("SEPS") copolymer having a number average molecular weight of about 81,000 g/mol. The weight percent of styrene is approximately 18% and the weight percent of ethylene/propylene is approximately 82%. The molecular weight increase in the EP block, while holding the molecular weight of the styrene block constant, increases the entanglement density, polymer chain persistence length and the relaxation time. The resulting laminate load decay rate and load loss measurements over a period of 12 hours at body temperature shows marked improvement over known CFSBL product. The laminate is used currently as side panel material in training pants because of the resistance of the laminate to sagging at body temperature. The CFSBL laminate described above is disclosed in U.S. Pat. No. 6,323,389 to Ooman et al., which is hereby incorporated by reference in its entirety herein. However, any one of the foregoing materials, or any combination of these materials, may be used to provide any portion(s) of the mask 10.

In a manner of use, the mask 10 is donned when the wearer pulls the mask 10 including the extension 24 including the lateral panels 26 connected by the cord 46 over his/her head 40 such that the mask 10 is positioned around the wearer's neck. The mask 10 is then moved upward and the mask body 14 is positioned and adjusted over the wearer's nose and mouth. The malleable member 18 is positioned across the wearer's nose and the top edge 16 and the upper portion 42 of the mask body 14 is positioned under his/her eyes. Each of the strings or ties 30 coupled to the upper section 32 of the side edges 22 of the mask body 14 is positioned at the back 38 of the wearer's head 40 and are fastened together by tying, knotting, and so forth. The ties 30 positioned at the back 38 of the wearer's head 40 are usually, but not by way of limitation, positioned at a level which is usually above the upper most portion of a wearer's ears; this secures the upper portion 42 of the mask body 14. The wearer then couples the connectable sections 36 of each lateral panel 26 together at or near the back 38 of his/her head 40 (usually, but not by way of limitation, at a level which is lower than the top of the wearer's ears); this action secures the lower portion 44 of the mask body 14, as shown in FIG. 1. To release the mask 10, the wearer unties the ties 30 or pulls them over his/her head to release the upper portion 42 of the mask body 14 from the wearer's face 12. The wearer un-couples the connectable sections 36 to release the lower portion 44 of the mask body 14 such that the mask 10 falls about the front of the wearer's neck and is held there via the cord 46. The mask 10 then may be pulled over the wearer's head 40 for removal.

Alternatively, one end of the cord 46 may be disconnected from its position on a lateral panel 26 (not shown). That is, at least one end of the cord 46 may be connected to the lateral panel 26 by use of a connecting material, such as, by way of non-limiting example, commercially available hook and loop material, snaps, button and button hole, mechanical hook and loop, an adhesive, including a cohesive adhesive, a pressure sensitive adhesive, and so forth, disposed on a portion of at least one end of the cord 46 (not shown). In this manner, the cord 46 is desirably re-connectable after being disconnected from its position on a lateral panel 26. This alternative permits a wearer to pull on the mask 10 while it is around his/her neck, to remove the mask 10 from around the wearer's neck. It will be understood that a wearer may replace the same mask 10 about his/her neck by re-connecting the end of the cord 46 on or near its previous position on the lateral panel (not shown).

In yet another alternative, the cord 46 may be configured to be disconnected, but not reconnected. That is, the cord 46 may be formed to easily separate within a portion of itself, for example, but not by way of limitation, when a portion of the cord is provided with perforations, and so forth. This alternative again permits the wearer to simply pull at the mask 10 when it is positioned about the front of his/her neck to remove the mask 10 completely. It will be understood, in this embodiment or any embodiment shown and/or described herein, that the position of the ties 30 and the extension 24 including lateral panels 26 may be reversed.

Figure 3:
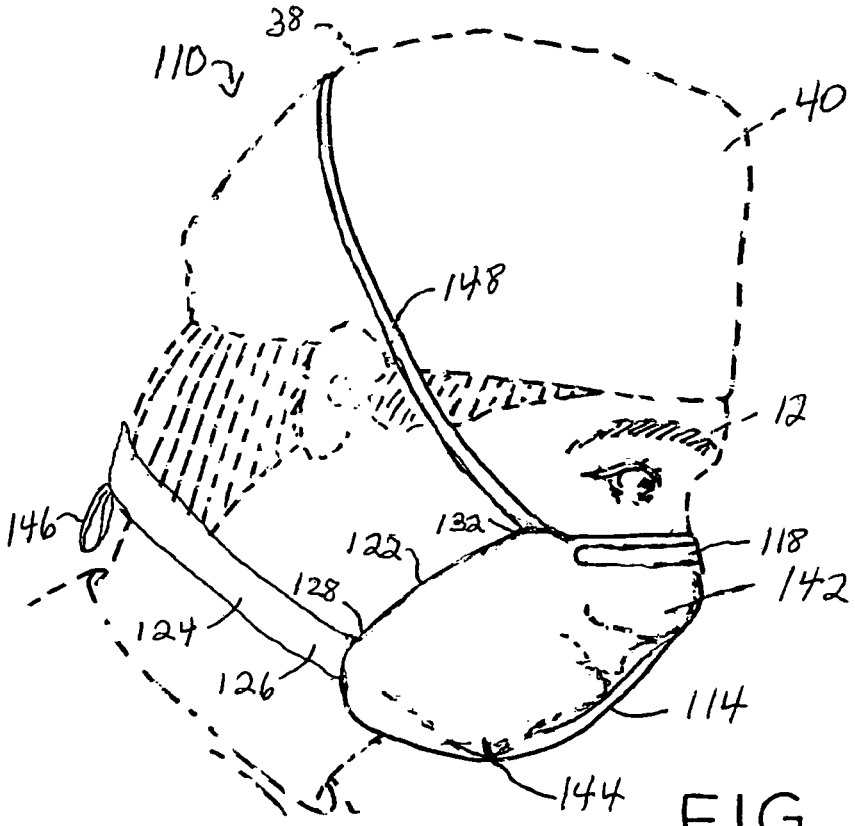
FIG. 3 is a side view of another embodiment of a disposable face mask which is shown being worn by a wearer (illustrated in phantom lines)

In another embodiment of the invention, as illustrated in FIGS. 3 and 4, the disposable mask 110 is similar to the disposable mask 10 shown in FIGS. 1 and 2 and previously described in detail herein, except the present mask is a cone-style mask 110. In addition, a connecting means or an extension 124 with lateral panels 126 is provided on a lower section 128 of the side edge 122 of the mask body 114. A cord 146 is coupled to and extends between the lateral panels 126. A connecting means or an elastic cord 148 is connected to the upper section 132 of the side edges 122 of the mask body 114.

In a manner of use, the mask 110 is donned when the wearer desirably pulls the mask 10 including elastic cord 148 and the extension 124 including the lateral panels 126 connected by the cord 146 over his/her head 40 such that the mask body 114 is positioned over the wearer's nose and mouth. The mask body 114 may then be moved over the wearer's face 12 and the malleable member 118 is desirably positioned across the wearer's nose and under his/her eyes. The elastic cord 148 is desirably moved into a position at the back 38 of the wearer's head 40, usually, but not by way of limitation, at a level which is usually above or about equal to the upper most portion of a wearer's ears, thereby securing the upper portion 142 of the mask body 114 on the wearer's face 12. The elastic cord may have a free end, which permits a wearer to pull the elastic cord tighter, or loosen the elastic cord, to provide greater comfort (not shown). The wearer then desirably couples together the connectable sections 136 of each lateral panel 126 at or near the back 38 of his/her head 40 (usually, but not by way of limitation, at a level which is lower than the top of the wearer's ears), securing the lower portion 144 of the mask body 114 in a position over the wearer's face 12, as shown in FIG. 4. To release the mask 10, the wearer desirably moves the elastic cord 148 off of his/her head to release the upper portion 142 of the mask body 114. The wearer may then un-couple and release the connectable sections 136 from each other such that the lower portion 144 of the mask body 114 is released and the mask 110 falls about the front of the wearer's neck, and is held there in place by the cord 146. The mask 110 may then be pulled over the wearer's head 40 for removal, or removed by any method shown and/or described herein. It will be understood, in this embodiment or any embodiment shown and/or described herein, that the elastic band 148 and the extension 124 including lateral panels 126 may be reversed on the mask body 114.

In yet another embodiment of the invention, as illustrated in FIGS. 5 and 6, the disposable mask 210 is similar to the disposable masks 10, 110 shown in FIGS. 1 and 2 and FIGS. 3 and 4, respectively, and previously described in detail herein, except the present mask is a noncollapsible-shaped mask 210. In addition, a connecting means or a first extension 224 with first lateral panels 226 are provided at an edge junction 250 of the mask body 214. A connecting means or a second extension 252 with second lateral panels 254 are provided adjacent thereto at the edge junction 250 of the top edge 216 and the lower edge 220 of the mask body 214. A cord 246 is coupled to and extends between the second lateral panels 254.

In a manner of use, the mask 210 is donned when the wearer desirably pulls the mask 210 including the first extension 224 including lateral panels 226 and the second extension 252 and lateral panels 254 over his/her head 40. The mask 210 may then be positioned to hang around the wearer's neck. The mask body 214 may then be moved over the wearer's face 12 and it is positioned over the wearer's nose and mouth. The malleable member 218 is desirably adjusted across the wearer's nose and under his/her eyes, and so forth. The wearer then desirably couples the connectable sections 236 of the first lateral panels 226 together at the back 38 of his/her head 40, usually, but not by way of limitation, at a level which may desirably be above the top of the wearer's ears, thereby securing the upper portion 242 of the mask body 214. The connectable sections 236 of the second lateral panels 254 are desirably connected together at or near the back 38 of the wearer's head 40 (usually, but not by way of limitation, at a level which is below the top of the wearer's ears), to secure the lower portion 244 of the mask body 214 in position on the wearer's face 12, as shown in FIG. 6.

To release the mask 210, the wearer desirably un-couples the connectable sections 236 of the first lateral portions 226 to release the upper portion 242 of the mask body 214 from the wearer's face 12. The wearer may then un-couple the connectable sections 236 of the second lateral panels 254 to release the lower portion 244 of the mask body 214 from the wearer's face, such that the mask 210 falls about the front of the front of the wearer's neck and is held there via the cord 246. The mask 210 may then be pulled over the wearer's head 40 for removal, or removed by any method shown and/or described herein. It will be understood, in this embodiment or any embodiment shown and/or described herein, that the cord 246 may be used with the first lateral panels 226 (not shown) and/or the second lateral panels 254, and/or any combination of the first and second lateral panels 226, 254.

It will be appreciated that the mask 10, 110, 210, shown in FIGS. 1–6, and any portions thereof, may include any feature, characteristic, and/or element shown and/or described in any embodiment herein, in any combination. While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A disposable face mask, comprising:

a mask body configured to substantially cover a nose and mouth of a wearer;

a connecting means provided with the mask body which holds at least a portion of the mask body in position on a wearer's face, the connecting means configured to releasably extend about a back of a user's head;

an extension provided with the mask body, the extension including two lateral panels, the lateral panels configured to cooperate to encircle a back of a wearer's head, each lateral panel including a connectable section on each free end of each lateral panel, each connectable section configured to be releasably coupled together at a back of a wearer's head, wherein one end of a cord is connected to one lateral panel and an opposite end of the cord is connected to another lateral panel, wherein when the connecting means is released from a back of a user's head, and when the two connectable sections are un-coupled and released from each other, the face mask moves from a wearer's face downward toward a front of a wearer's neck and is held about a wearer's neck by the cord's connection between the two lateral panels.

2. The disposable face mask of claim 1, wherein the connecting means includes a pair of ties.

3. The disposable face mask of claim 1, wherein the connecting means include an elastic cord.

4. The disposable face mask of claim 1, wherein the connecting means includes an extension.

5. The disposable face mask of claim 4, wherein the extension includes two lateral panels, each lateral panel including a connectable section.

6. The disposable face mask of claim 5, wherein a cord is coupled to and extends between the two lateral panels.

7. The disposable face mask of claim 1, wherein each connectable section has one of a hook and a loop material.

8. The disposable face mask of 1, wherein each connectable section includes a pressure sensitive adhesive.

9. The disposable face mask of 1, wherein each connectable section includes a cohesive adhesive.

10. The disposable face mask of claim 1, wherein each connectable section includes snaps.

11. The disposable face mask of claim 1, where each connectable section includes one of a button and a button hole.

12. The disposable face mask of claim 1, wherein each connectable section includes one of a mechanical hook and a loop.

13. The disposable face mask of claim 1, wherein at least a portion of the cord is constructed from an elastomeric material.

14. The disposable face mask of claim 1, wherein at least a portion of the cord is constructed from a non-elastomeric material.

15. The disposable face mask of claim 1, wherein at least one end of the cord disconnects from one of the lateral panels.

16. The disposable face mask of claim 15, wherein the at least one end of the cord includes a connecting material which permits the one end to be easily connected and released from the lateral panel.

17. The disposable face mask of claim 1, wherein the cord is constructed to separate from itself to release the mask from a wearer's neck when pulled by a wearer.

18. The disposable face mask of claim 1, wherein the mask body includes pleats.

19. The disposable face mask of claim 1, wherein the mask body includes a noncollapsible-shaped mask body.

20. The disposable face mask of claim 1, wherein the mask body includes a cone-shaped mask body.

21. The disposable face mask of claim 1, wherein at least a portion of the face mask includes a barrier material.

22. The disposable face mask of claim 1, wherein the mask body includes a duck bill-shaped body.

23. A disposable face mask, comprising:

a mask body configured to substantially cover a nose and mouth of a wearer;

a first extension provided with the mask body, the first extension including a pair of first lateral panels, the first lateral panels configured to cooperate to encircle a back of a wearer's head, each first lateral panel including a connectable section on each free end of each first lateral panel, each connectable section configured to be releasably coupled together at a back of a wearer's head;

a second extension provided with the mask body, the second extension including a pair of second lateral panels, the second lateral panels configured to cooperate to encircle a back of a wearer's head, each second lateral panel including a connectable section on each free end of each second lateral panel, each connectable section configured to be releasably coupled together at a back of a wearer's head; and a cord coupled to and extending between at least one of the first pair of lateral panels and the second pair of lateral panels, wherein when the two connectable sections of the first lateral panels and the second lateral panels are uncoupled and released from each other, the face mask moves from a wearer's face downward toward a front of a wearer's neck and is held about a wearer's neck by the cord's connection between the lateral panels.

24. The disposable face mask of claim 23, wherein each connectable section has one of a hook and a loop material.

25. The disposable face mask of 23, wherein each connectable section includes a pressure sensitive adhesive.

26. The disposable face mask of 23, wherein each connectable section includes a cohesive adhesive.

27. The disposable face mask of claim 23, wherein each connectable section includes snaps.

28. The disposable face mask of claim 23, wherein at least a portion of the cord is constructed from an elastomeric material.

29. The disposable face mask of claim 23, wherein at least a portion of the cord is constructed from a non-elastomeric material.

30. The disposable face mask of claim 23, wherein at least one end of the cord disconnects from one of the lateral panels.

31. The disposable face mask of claim 30, wherein the at least one end of the cord includes a connecting material which permits the one end to be easily connected and released from the lateral panel.

32. The disposable face mask of claim 23, wherein the cord is constructed to separate from itself to release the mask from a wearer's neck when pulled by a wearer.

* * * * *